United States Patent [19]

Denneman et al.

[11] 4,422,017

[45] Dec. 20, 1983

[54] ELECTRODELESS GAS DISCHARGE LAMP

[75] Inventors: Jan W. Denneman; Hendrik B. B. van Dam; Petrus F. J. A. Wouters, all of Eindhoven, Netherlands

[73] Assignee: U.S. Philips Corporation, New York, N.Y.

[21] Appl. No.: 407,185

[22] Filed: Aug. 11, 1982

Related U.S. Application Data

[63] Continuation of Ser. No. 120,968, Feb. 13, 1980.

[30] Foreign Application Priority Data

Mar. 9, 1979 [NL] Netherlands ..... 7901897

[51] Int. Cl.[3] ..... H05B 41/16; H05B 41/24

[52] U.S. Cl. ..... 315/248; 315/344; 315/39; 313/47

[58] Field of Search ..... 315/248, 62, 57, 70, 315/344, 39; 313/49, 94, 493

[56] References Cited

U.S. PATENT DOCUMENTS

| | | | |
|---|---|---|---|
| 4,005,330 | 1/1977 | Glascock, Jr. et al. | 315/57 |
| 4,017,764 | 4/1977 | Anderson | 315/267 |
| 4,117,378 | 9/1978 | Glascock, Jr. | 315/39 |
| 4,298,828 | 11/1981 | Justice et al. | 315/248 |

*Primary Examiner*—Saxfield Chatmon

*Attorney, Agent, or Firm*—Robert S. Smith

[57] ABSTRACT

An electrodeless gas discharge lamp having a closed loop core of a magnetic material the part of which core extends through the lamp vessel, a high frequency field being induceable in this core by means of an h.f. generator in the lamp base, said core is assembled of at least two operable core portions at least a major part of one portion lying within the lamp vessel, and the other of the two portions being located in the lamp base, the lamp base being detachably secured to the lamp vessel.

16 Claims, 1 Drawing Figure

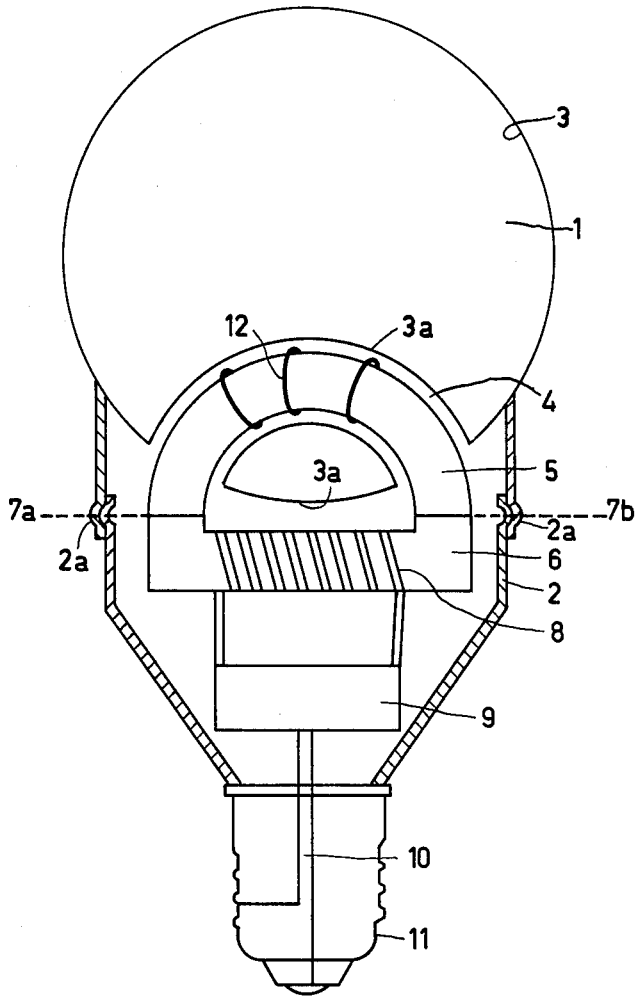
3
1
12
3a
4
3a
5
7a
7b
2a
2a
6
2
8
9
10
11

ELECTRODELESS GAS DISCHARGE LAMP

This is a continuation of application Ser. No. 120,968 filed Feb. 13, 1980.

The invention relates to an electrodeless gas discharge lamp having a lamp base and a lamp vessel which is filled with a metal vapor and one or more rare gases, the lamp comprising a closed loop core of a magnetic material, part of which core extends through the lamp vessel, a high frequency magnetic field being induceable in the core by means of an h.f. generator in the lamp base. Such a lamp is disclosed in the U.S. Pat. No. 3,987,335.

In such electrodeless gas discharge lamps, the electric discharge in the lamp vessel is maintained by an electric field induced by an induction coil having a core of a magnetic material such as ferrite by a high-frequency magnetic field (25 kHz or higher). The absence of electrodes in the lamp vessel makes it possible to produce lamps having a relatively long life. The lamps have such a luminous flux, shape, and color rendering that they are suitable to be used as an alternative for incandescent lamps for domestic lighting purposes.

A high-frequency generator is used to induce the electric field in the lamp vessel. This generator is included in the lamp base and is fed from a line voltage supply.

The lamp described in the above-mentioned U.S. patent comprises a substantially globular lamp vessel, a circular core for inducing a high frequency electric field lying partially outside the lamp vessel. The primary windings of the induction coil are provided around the portion of the core lying outside the lamp vessel. Accordingly, it is not necessary to provide special feed-through constructions in the lamp vessel wall for the electric supply leads of these windings. In addition, a closed loop core has the advantage that radio interference caused by the lamp is reduced to the greatest possible extent.

In a lamp described in the above-mentioned U.S. patent a portion of the closed loop ferrite core is feed-through two areas in the lamp vessel wall. The feed-through is connected in a gas-tight manner to the wall of the lamp vessel, for example, by means of a sealing glass. Such a connection is not easy to produce for the described closed-loop core. In the region of the feed-through, differences occur in the thermal expansion between the magnetic core material and the wall of the lamp vessel owing to the heat transport in the core, so that the seals are subjected to mechanical loads. Consequently, there is a possible risk of leakage, or even of fracture, of the lamp vessel. The lamp described in the U.S. patent has the practical drawback that the lamp vessel and the lamp base containing the high-frequency supply unit are not detachable. In case of a fault in the lamp vessel or in the lamp base the entire lamp must be replaced.

It is an object of the invention to provide a lamp in which the above-mentioned drawback is at least mitigated.

This object is accomplished by means of a lamp of the type mentioned in the opening paragraph which, according to the invention, is characterized in that the magnetic core is assembled from at least two separable core portions, at least a major part of one portion lying within the lamp vessel, and the other of the two portions being located in the lamp base, the lamp base being detachably secured to the lamp vessel.

A lamp according to the invention has the advantage that the lamp vessel can be separated in a simple manner from the high frequency supply section and therefore, either can be replaced if faulty. The lamp vessel can be attached to the lamp base by means of, for example, a snap fit, the portions of the core then forming a closed loop.

In a lamp according to the invention, complicated and vulnerable sealed-in feed-through connections can be avoided by attaching the portion of the ring core lying within the lamp vessel to the wall of lamp vessel by means of a cement or a sealing glass.

Preferably, the part of the one core portion which lies mainly within the lamp vessel is situated in a tubular channel formed as part of the lamp vessel. The core portion intended to be included in the lamp vessel can then be slid in a simple manner into this channel during production of the lamp and thereafter be secured thereto. A sealed feed-through for the core portion is then not necessary. As the wall of the channel can be spaced from the core adequate discharge of the heat generated in the magnetic core can be realized by means of conduction and convection. A further advantage of this embodiment is that there is no need for coating the core portion within the lamp vessel with a layer (for example glass, enamel or ceramic) to protect the magnetic material from the action of the metal vapor in the lamp vessel or to prevent a material originating from the magnetic material of the core from contaminating the fluid mixture in the lamp vessel.

In a preferred embodiment of a gas discharge lamp according to the invention the wall of the tubular channel within the lamp vessel is provided with an electrically non-conducting, reflecting layer. The light radiation produced in the lamp vessel is then reflected back into the lamp vessel, thereby increasing the efficiency of the lamp. In addition, the heat transferred to the core by radiation is reduced by the reflecting layer. Titanium oxide or magnesium oxide are examples of a suitable layer material.

In a special embodiment of a lamp according to the invention some turns of an electrical conductor, such as a wire, a strip, or a foil, are provided around the part of the core within the lamp vessel to facilitate ignition of the lamp.

Lamps according to the invention are preferably operated at frequencies above 1 MHz. At these frequencies the efficiency of the inductive energy coupling into the gas discharge is high. This is a result of the relatively low electric conductivity of the discharge plasma in the lamp vessel. The lamps can be operated at, for example, a frequency of 13.56 MHz.

The above-mentioned lamp vessels filled with a metal vapor and one or more rare gases, comprising a portion of a core of a magnetic material, may be marketed as a separate item. Such lamp vessels can then be attached, for example by means of a suitable coupling, to a lamp base (which comprises, for example, the other portion of the core of magnetic material and a high frequency generator).

An embodiment of an electrodeless gas discharge lamp according to the invention will now further be described with reference to the accompanying drawing.

In the drawing an electrodeless low-pressure mercury vapor discharge lamp is shown schematically in longitudinal section.

The lamp comprises a glass lamp vessel 1 and a synthetic resin lamp base 2. The inner surface of the wall of the lamp vessel is provided with a luminescent layer 3, which converts the ultra-violet radiation produced in the lamp vessel into visible light. The lamp vessel comprises an arcuate tubular channel 4 which encloses a major part of a semi-circular ferrite core 5. This ferrite core forms part of a closed ring core which is completed by a separate ferrite yoke 6. The yoke 6 is housed in the lamp base 2 which is connected in a detachable manner by means of a snap fit (*2a*) to the lamp vessel 1. The line of separation of the two ferrite portions is in the plane *7a–7b*. An induction coil 8 is wound around the yoke 6. This coil is fed from a high-frequency supply unit 9, which receives its energy from a line voltage supply via the supply leads 10 within the sleeve 11 and preferably generates a lamp operating frequency in excess of 1 MHz.

In a practical embodiment of a lamp described above, the diameter of the globular glass lamp vessel is approximately 80 mm. The lamp vessel contains a quantity of mercury (approximately 20 mg) and a rare gas mixture of argon and krypton at a pressure of 1.5 torr. A luminescent layer consisting of a mixture of three phosphors, namely blue-luminescing, bivalent europium-activated barium-magnesium aluminate, green-luminescing, terbium-activated cerium magnesium aluminate and red-luminescing trivalent europium-activated yttrium oxide, is disposed on the inside of the lamp vessel wall. The outer wall surface of the tubular channel is provided with a heat and light reflecting layer (titanium dioxide) *3a*. This layer is electrically non-conductive to prevent a disturbance in the discharge. This layer is also provided on a portion of the lamp vessel wall which faces the lamp base. The magnetic material of the core consists of a ferrite having a relative permeability above 200 and a low degree of dissipation for high frequency energy at frequencies above 1 MHz. An induction coil 8 consisting of a copper foil strip having a width of approximately 2 mm and being approximately 0.1 mm thick, is wound around the yoke. The number of turns is 11 and the inductance of this coil is approximately 25 μuH. The high-frequency oscillator 9 has a frequency of approximately 5 MHz.

In addition, to facilitate ignition of the lamp there are 20 turns of a copper foil strip (shown schematically in the drawing by 12) having a width of approximately 2 mm and being approximately 0.1 mm thick around the core portion lying within the tubular channel. For an applied power to the gas discharge of approximately 16 watts the luminous flux was 1000 lm. The efficiency of the high frequency supply unit is approximately 90%, so that the luminous efficacy of the system (lamp+-power supply) is 55 lm/W.

What is claimed is:

1. An electrodeless gas discharge lamp having a lamp base and a lamp vessel having an elongated tubular channel extending completely through said lamp vessel and having a fluid tight wall with no fluid communication between the interior of said channel and the interior of said vessel, said vessel being filled with a metal vapor and one or more rare gases, the lamp comprising a closed loop core of a magnetic material, part of said core extending through the lamp vessel, a high frequency magnetic field being induceable in the core by means of an h.f. generator in the lamp base characterized in that the magnetic core is assembled from at least two separable core portions, at least a major part of one portion lying within said channel, said channel being dimensioned and configured for passage of said major part thereinto, said major portion being semi-circular shaped, and the other of the two portions being located in the lamp base, the lamp base being detachably secured to the lamp vessel, said part of said one core portion which lies mainly within the lamp vessel being disposed in said elongated channel formed as part of the lamp vessel.

2. A gas discharge lamp as claimed in claim 1, characterized in that the wall of the elongated channel is provided with an electrically non-conducting reflecting layer.

3. A gas discharge lamp as claimed in claim 1, characterized in that the part of said one core portion lying within said elongated channel is provided with a plurality of electrically conductive turns therearound to facilitate ignition of the lamp.

4. A gas discharge lamp as claimed in claim 2, characterized in that the part of said one core portion lying within said elongated channel is provided with a plurality of electrically conductive turns therearound to facilitate ignition of the lamp.

5. A gas discharge lamp as claimed in claim 1, characterized in that the operating frequency of the high frequency generator exceeds 1 MHz.

6. A gas discharge lamp as claimed in claim 2, characterized in that the operating frequency of the high frequency generator exceeds 1 MHz.

7. A gas discharge lamp as claimed in claim 3, characterized in that the operating frequency of the high frequency generator exceeds 1 MHz.

8. A gas discharge lamp as claimed in claim 4, characterized in that the operating frequency of the high frequency generator exceeds 1 MHz.

9. A lamp vessel filled with a metal vapor and one or more rare gases, comprising a portion of a core of magnetic material suitable for use in a gas discharge lamp as claimed in claim 1.

10. A lamp vessel filled with a metal vapor and one or more rare gases, comprising a portion of a core of magnetic material suitable for use in a gas discharge lamp as claimed in claim 2.

11. A lamp vessel filled with a metal vapor and one or more rare gases, comprising a portion of a core of magnetic material suitable for use in a gas discharge lamp as claimed in claim 3.

12. A lamp vessel filled with a metal vapor and one or more rare gases, comprising a portion of a core of magnetic material suitable for use in a gas discharge lamp as claimed in claim 4.

13. A lamp vessel filled with a metal vapor and one or more rare gases, comprising a portion of a core of magnetic material suitable for use in a gas discharge lamp as claimed in claim 5.

14. A lamp vessel filled with a metal vapor and one or more rare gases, comprising a portion of a core of magnetic material suitable for use in a gas discharge lamp as claimed in claim 6.

15. A lamp vessel filled with a metal vapor and one or more rare gases, comprising a portion of a core of magnetic material suitable for use in a gas discharge lamp as claimed in claim 7.

16. A lamp vessel filled with a metal vapor and one or more rare gases, comprising a portion of a core of magnetic material suitable for use in a gas discharge lamp as claimed in claim 8.

* * * * *